US005475410A

United States Patent [19]

Durst et al.

[11] Patent Number: 5,475,410

[45] Date of Patent: Dec. 12, 1995

[54] SEAL FOR INK JET PRINTHEAD

[75] Inventors: Homer D. Durst, Springfield; David J. Stephens, Springboro, both of Ohio

[73] Assignee: Scitex Digital Printing, Inc., Dayton, Ohio

[21] Appl. No.: 853,681

[22] Filed: Mar. 19, 1992

[51] Int. Cl.[6] ..... B41J 2/085

[52] U.S. Cl. ..... 347/76; 347/29; 347/77; 347/90

[58] Field of Search ..... 347/29, 32, 74, 347/76, 77, 90

[56] References Cited

U.S. PATENT DOCUMENTS

| | | | |
|---|---|---|---|
| 4,266,231 | 5/1981 | Drago et al. | 347/76 |
| 4,305,079 | 12/1981 | Mix, Jr. | 347/76 |
| 4,413,265 | 11/1983 | Kockler et al. | 347/76 |
| 4,573,057 | 2/1986 | Sutera et al. | 347/90 X |
| 4,626,869 | 12/1986 | Piatt | 347/74 |
| 4,928,115 | 5/1990 | Fagerquist et al. | 347/108 |

*Primary Examiner*—William J. Royer
*Attorney, Agent, or Firm*—Barbara Joan Haushalter

[57] ABSTRACT

An ink jet printer includes an ink jet printhead having a drop generator and an ink drop charging and catching assembly. An elastomeric seal mounted on a lever arm about a pivot remote from the charging and catching assembly seals the ink drop generator and charging and catching assembly when the ink jet printer is not in use.

4 Claims, 2 Drawing Sheets

SEAL FOR INK JET PRINTHEAD

FIELD OF THE INVENTION

The present invention relates to continuous ink jet printing and more specifically to apparatus for sealing the area of the catcher in an ink jet printhead.

BACKGROUND OF THE INVENTION

In continuous ink jet printing, electrically conductive ink is supplied under pressure to a manifold region that distributes the ink to a plurality of orifices, typically arranged in a linear array(s). The ink discharges from the orifices in filaments which break into droplet streams. Individual droplets in the streams are selectively charged in the region of the break-off from the filaments, and charged drops are deflected by electrostatic forces from their original trajectories. The deflected drops may be caught and recirculated and the undeflected drops allow to proceed to a print receiving medium.

When the ink jet printhead is not in operation, means must be provided to seal the printhead so that ink doesn't dry in the catcher face area, or weep from the jets and soil the apparatus or adjacent work surfaces. One approach to providing a seal is taught in U.S. Pat. No. 4,928,115 issued May 22, 1990 to Fagerquist, et al which discloses a seal over the printhead when the printhead is not in operation. The seal described in the '115 patent is a sealing wall that slides in a slot between a position where the ink jet charging and deflecting area is open and a position where the charging and deflection area is covered by the sealing wall. The mechanism for moving the sealing wall is located in front of the ink jet printhead and includes a bale arm that controls cams that move the sealing wall.

This prior art arrangement suffers from a number of shortcomings. First, ink may enter the area between the sealing wall and the slot it slides in and when dry, effectively cement the sealing wall into the slot against proper movement. Furthermore, the mechanism for moving the sealing wall occupies a substantial amount of space in front of the printhead, thereby undesirably increasing the footprint of the printhead. Since such printheads are employed in bindery lines where it is desirable to place the printhead as near to the seam of a signature as possible, a minimum sized footprint is desirable.

SUMMARY OF THE INVENTION

It is therefore an object of the present invention to provide an improved sealing mechanism on a continuous ink jet printhead that avoids the problems noted above. The ink jet printhead according to the present invention includes a sealing head of elastomeric material that is carried by a pivot arm, the pivot point of which is located a distance from the ink jet charge and deflection area to avoid contamination by ink. According to a further aspect of the present invention, the pivot arm is driveable by a solenoid to move the sealing head between open and closed positions, and the solenoid is coupled to the pivot arm through a slip joint that allows the printhead to be removed from the ink jet printer without disturbing the alignment between the sealing head and the printhead catcher.

MODES OF CARRYING OUT THE INVENTION

Figure 1:
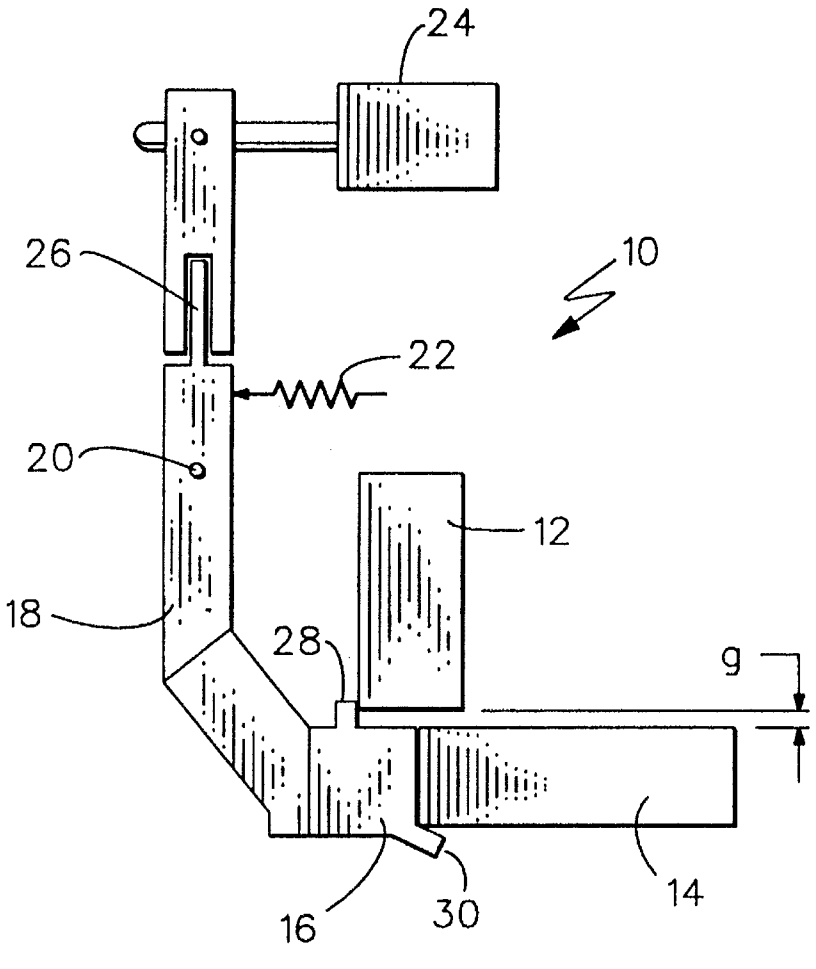
FIG. 1 is a schematic side view of an ink jet printhead sealing mechanism according to the present invention showing the sealing mechanism in the closed position.

Referring to FIG. 1, an ink jet printhead having a sealing mechanism according to the present invention is shown. The ink jet printhead, generally designated 10, includes a resonator 12, a catcher/charge plate assembly 14, and an elastomeric sealing head 16. The sealing head 16 is mounted on a pivot arm 18 that pivots about a pivot point 20. The pivot point 20 is located a distance away from the ink jet printhead thereby avoiding ink contact and fouling of the pivot point. The sealing head 16 is movably urged into sealing engagement with the resonator 12 and catcher/charge plate 14 by a spring 22. The pivot am 18 is coupled to a solenoid 24 through a slip coupling 26 that allows the printhead assembly to be easily disconnected from solenoid 24 without disturbing the orientation of the print sealing head 16 with the resonator assembly 12 and the catcher/charge plate 14.

The elastomeric sealing head 16 defines a first lip 28 adapted to engage and seal against the bottom front edge of the resonator body 12 and a second lip 30 adapted to engage and seal against the bottom front edge of the catcher/charge plate assembly 14.

Figure 3:
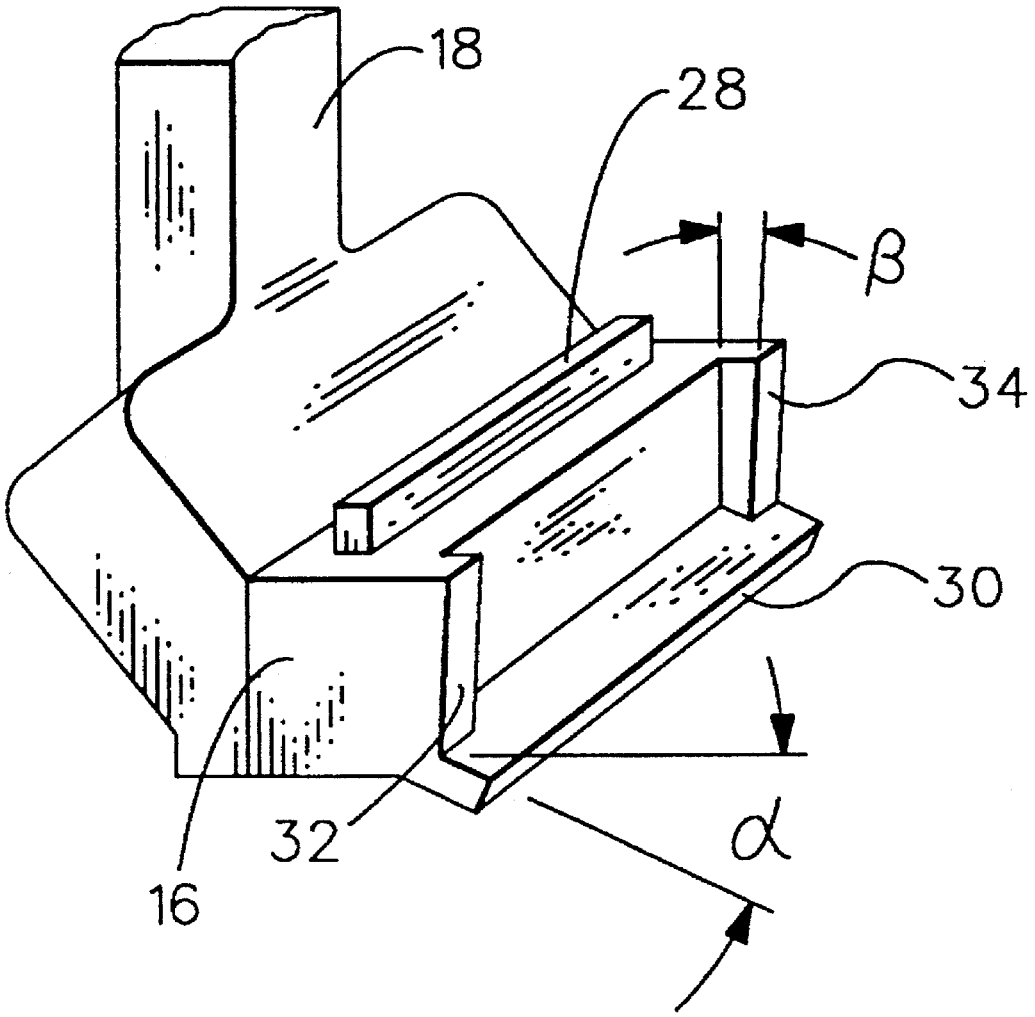
FIG. 3 is a perspective view of the sealing head of an ink jet printhead sealing mechanism according to the present invention.

As shown in FIG. 3, the elastomeric seal 16 further includes protrusions 32 and 34 adapted to engage and seal the sides of the catcher/charge plate 14. It should be noted that when the seal 16 is in engagement with the resonator 12 and the catcher/charge plate 14, no part of the seal 16 contacts the bottom face of the resonator 12. Proper functioning of the ink jet printhead requires a gap g between the sealing head 16 and the bottom of the resonator 12 that is between a minimum distance wherein trapped ink is held in the gap by capillary forces and therefore prevents proper operation, and a maximum gap to ensure proper air flow around the printhead.

Figure 2:
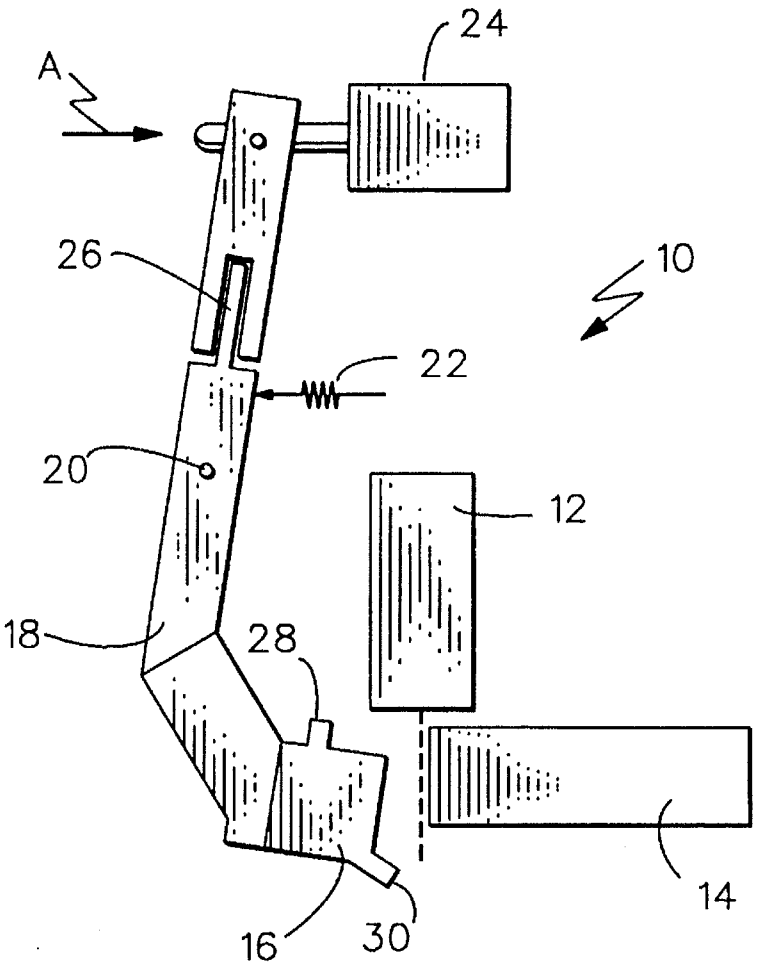
FIG. 2 is a schematic side view similar to FIG. 1 showing the sealing mechanism in an open position.

In operation, the printhead is started with the sealing head 16 in the closed position as shown in FIG. 1. After a programmed start up period in which ink jet formation and stimulation are achieved, solenoid 24 is actuated in the direction of arrow A as shown in FIG. 2 to move the sealing head 16 away from the face of the catcher 14.

In a preferred implementation of the sealing head 16 according to the present invention, a printhead having a one inch wide print bar with 132 jets was provided with a silicone rubber seal configured as shown in FIG. 3 and having a durometer shore A hardness of 30. The seal 16 was formed by compression molding. Lip 28 was 0.030" thick by 0.080" high. Lip 30 was 0.035" thick by 0.017" long and arranged at an angle $\alpha$ of 25°. Sealing protrusions 32 and 34 were 0.030" thick by 0.052" deep. The front surfaces of the protrusions 32 and 34 were angled at an angle $\beta$ of 3° from the vertical to match the angle of the printhead catcher face. The printhead was operated with the sealing head according to the present invention and the printhead was observed to operate satisfactorily in both start-up and operational modes.

Advantages

The printhead sealing mechanism according to the present invention is advantageous in that the mounting means are positioned at a distance from the ink in the ink jet printhead thereby avoiding the problem of dried ink preventing operation of the ink jet printhead sealing mechanism. The printhead sealing mechanism according to the present invention is also advantageous in that it employs less space directly in front of the printhead than the prior art mechanism. Furthermore, the slip joint mounting allows the ink jet printhead to be removed from the solenoid mechanism without disturbing the orientation between the sealing head and the ink jet printhead.

We claim:

1. An ink jet printer, comprising:

a. an ink jet printhead having an ink drop generator, and a charging and catching assembly located adjacent the ink drop generator;

b. an elastomeric seal defining a first lip adapted for sealing engagement with said ink drop generator and a second lip adapted for sealing engagement with said charging and catching assembly; and c. a lever mounted for pivotal movement about a pivot point removed from the vicinity of the charging and catching assembly, said elastomeric seal being carried by said lever and movable between a closed position wherein said elastomeric seal is in ink sealing contact with said ink drop generator and said charging and catching assembly and a second position wherein said elastomeric seal is away from said ink drop generator and charging and catching assembly.

2. The ink jet printer claimed in claim 1, further comprising solenoid means for moving said lever and slip joint coupling means for releasably coupling said solenoid means to said lever.

3. The ink jet printer claimed in claim 1, wherein said elastomeric seal comprises silicone rubber having a durometer hardness of shore A 30.

4. The ink jet printer claimed in claim 1, wherein said elastomeric seal when in said closed position does not contact the bottom surface of said ink drop generator and defines a gap between said bottom surface and the seal sufficiently wide to avoid trapping ink between said seal and said ink drop generator by capillary attraction.

* * * * *